United States Patent [19]

Scott

[11] 4,098,251

[45] Jul. 4, 1978

[54] ARRANGEMENT FOR MOUNTING A FUEL METERING CONTROL PUMP ON AN ENGINE

[75] Inventor: Ian J. C. Scott, Madison Heights, Mich.

[73] Assignee: Chrysler Corporation, Highland Park, Mich.

[21] Appl. No.: 782,107

[22] Filed: Mar. 28, 1977

[51] Int. Cl.[2] ..... F02B 77/00

[52] U.S. Cl. ..... 123/195 A; 123/136; 123/139 E; 123/198 E

[58] Field of Search ..... 123/195 A, 198 C, 198 E, 123/136, 139 E

[56] References Cited

U.S. PATENT DOCUMENTS

| | | | |
|---|---|---|---|
| 2,104,448 | 1/1938 | Babitch et al. | 123/195 A |
| 2,143,935 | 1/1937 | Chandler | 123/195 A |
| 2,482,332 | 9/1949 | Eckert | 123/195 A |
| 2,549,948 | 4/1951 | Valentine | 123/195 A |
| 3,996,914 | 12/1976 | Ciall et al. | 123/198 E |

*Primary Examiner*—Charles J. Myhre
*Assistant Examiner*—Ira S. Lazarus
*Attorney, Agent, or Firm*—Baldwin & Newtson

[57] ABSTRACT

An arrangement for mounting a fuel metering control pump on an internal combustion engine comprises the air intake system via which air is drawn into the engine, said system including a generally annular support element on which the control pump mounts. Means are provided for mounting the annular support element on the intake manifold of the engine with induction air passing through a central aperture defined by the inner periphery of the annular support element. The control pump is disposed adjacent this aperture and meters fuel via a suitable fuel distribution system into the induction air stream to form the combustible mixture for the engine. The control pump includes an inlet port which passes through an opening in the wall of the annular support element to provide for connection of a fuel supply line thereto exteriorly of the air intake system. A similar arrangement is provided for a return line to the fuel tank. The annular support element is further provided with an upstanding flange around its outer periphery on which an annular element is supported. The usual annular air filter element is supported on this latter annular element and a cover encloses the entire assembly.

9 Claims, 5 Drawing Figures

ARRANGEMENT FOR MOUNTING A FUEL METERING CONTROL PUMP ON AN ENGINE

BACKGROUND AND SUMMARY OF THE INVENTION

The present invention pertains to an internal combustion engine which utilizes a control pump for metering fuel to the engine and is particularly concerned with a novel arrangement for mounting a control pump of this type on an engine.

The present invention possesses a number of significant advantages. For one, the control pump is contained entirely within the induction air intake system of the engine which draws cooler air from outside the engine compartment to provide a natural convective cooling of the pump. This means that liquid fuel experiences a smaller temperature rise in passing through the control pump which is beneficial in developing fuel-air mixtures. Moreover, the mounting arrangement tends to shield the control pump from conductive and radiant engine heat. The control pump is located adjacent the location at which the fuel it pumps is sprayed into the induction air so that only a short line from the pump outlet is needed; this makes the system more responsive to changing engine fuel demand. Another advantage is that fuel lines to and from the control pump can be made connectible entirely exteriorly of the air intake system. Only a small number of fuel lines connect to the control pump simplifying connection and disconnection, while minimizing the likelihood of leakage. The construction is also compact since the pump mounts in otherwise unoccupied space. Engine vibration has not been found to have any detrimental effect.

The foregoing features, advantages and benefits, along with additional ones, will be seen in the ensuing description and claims which are to be considered in conjunction with the accompanying drawings.

BRIEF DESCRIPTION OF THE DRAWINGS

The drawings disclose a preferred embodiment of the present invention according to the best mode presently contemplated in carrying out the invention.

DESCRIPTION OF THE PREFERRED EMBODIMENT

Figure 1:
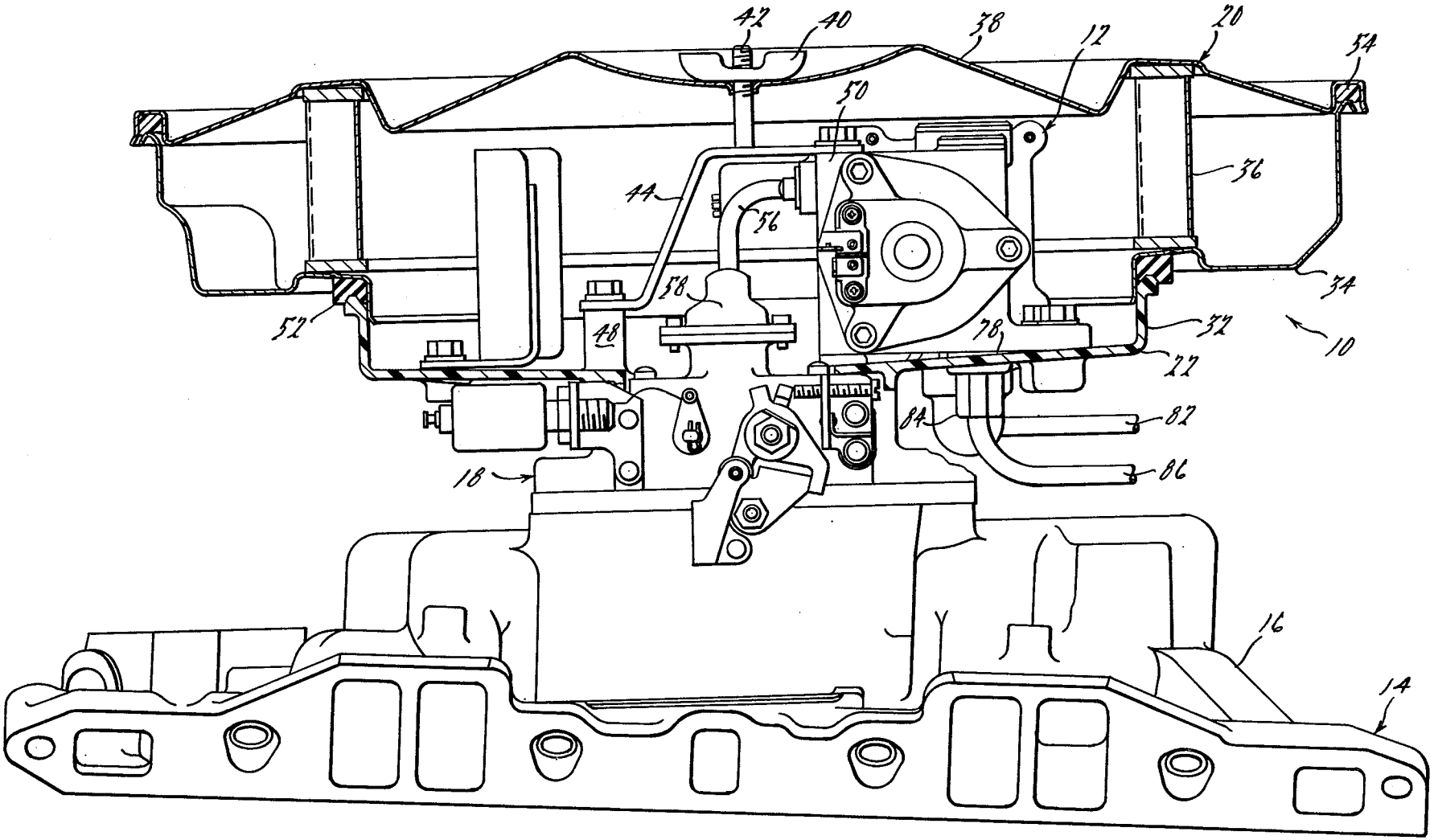
FIG. 1 is a side elevational view, partly in section, through a portion of an internal combustion engine embodying a control pump mounting arrangement pursuant to principles of the present invention.
Figure 2:
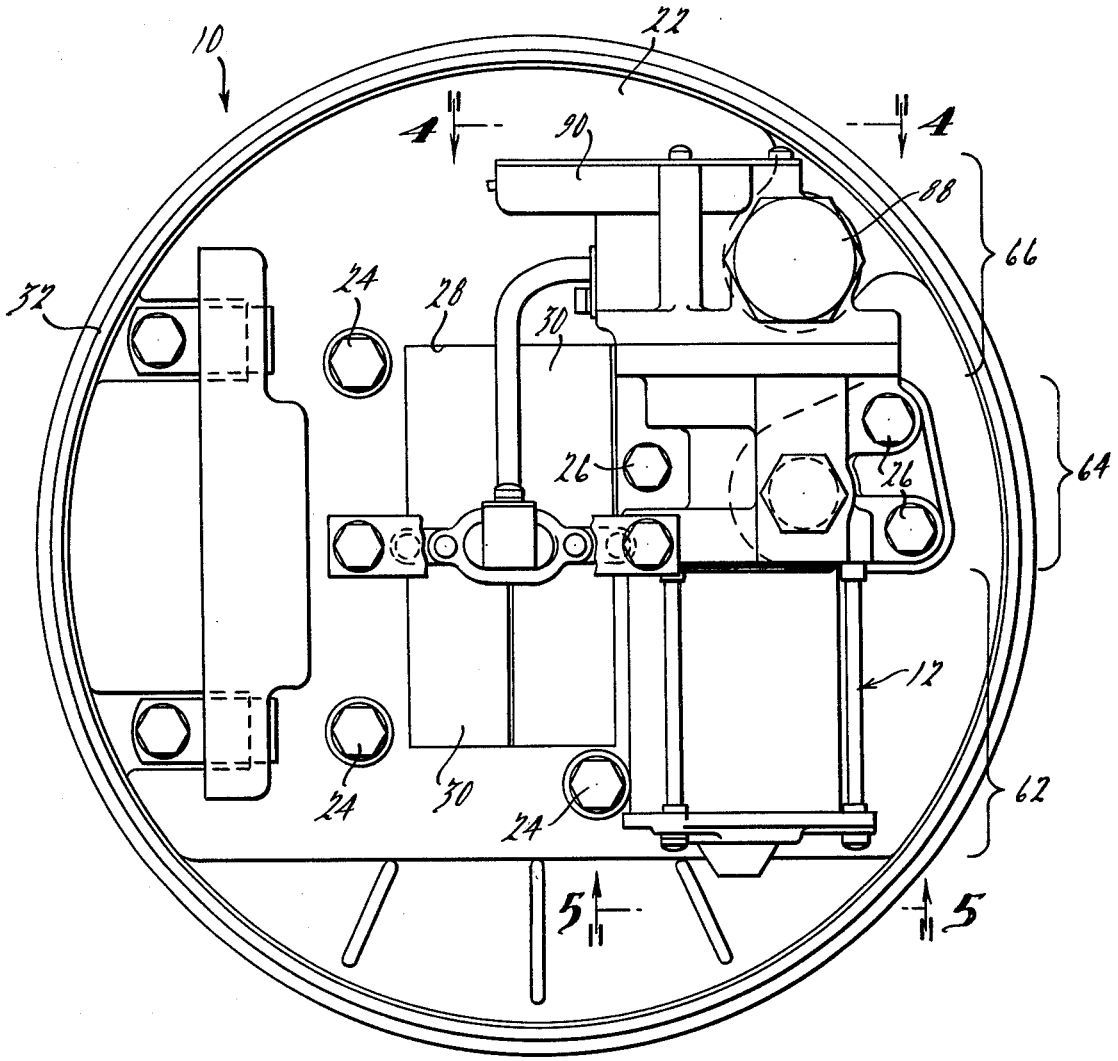
FIG. 2 is a plan view of a portion of FIG. 1 with portions removed and broken away.
Figure 3:
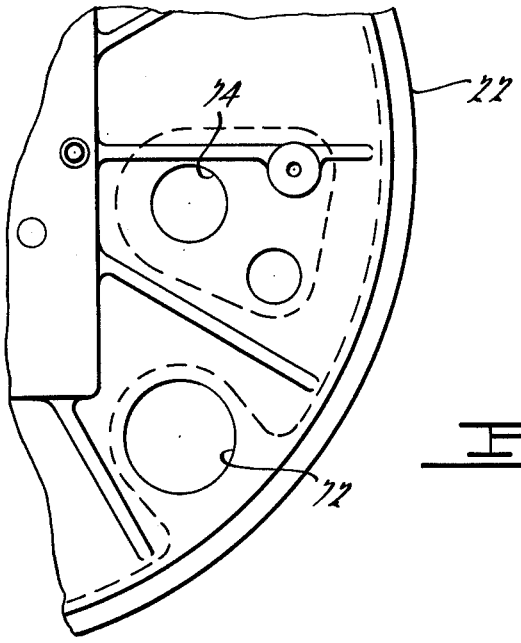
FIG. 3 is a fragmentary bottom view of one of the elements of FIG. 2 shown by itself.
Figure 4:
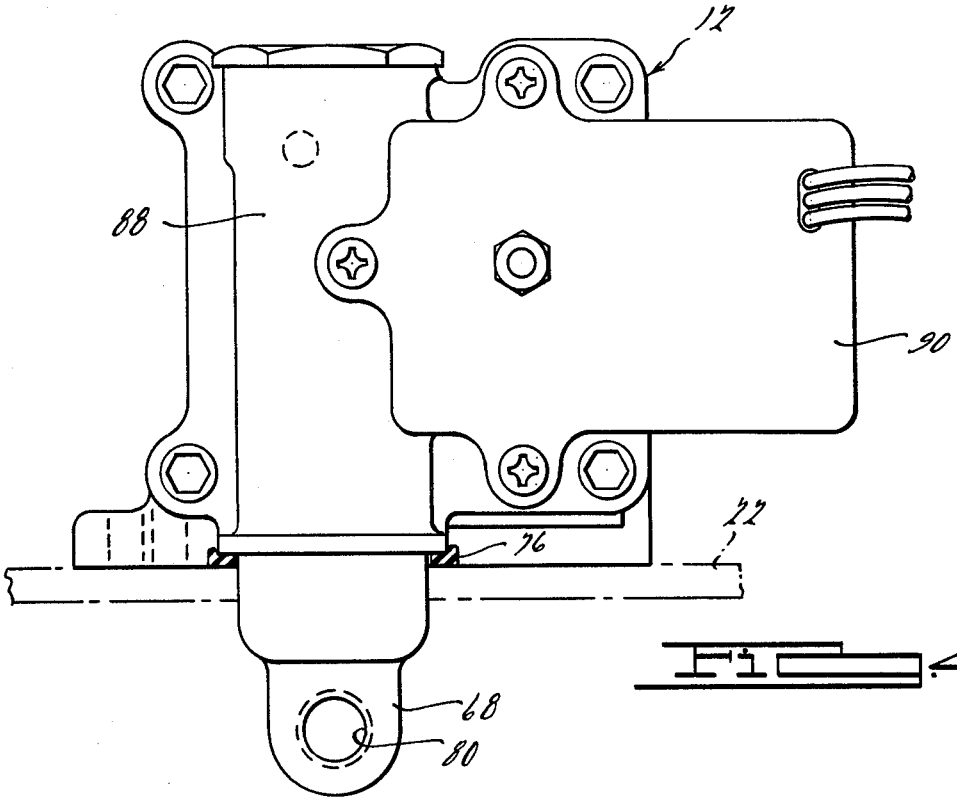
FIG. 4 is a view on a slightly enlarged scale taken generally in the direction of arrows 4—4 in FIG. 2.
Figure 5:
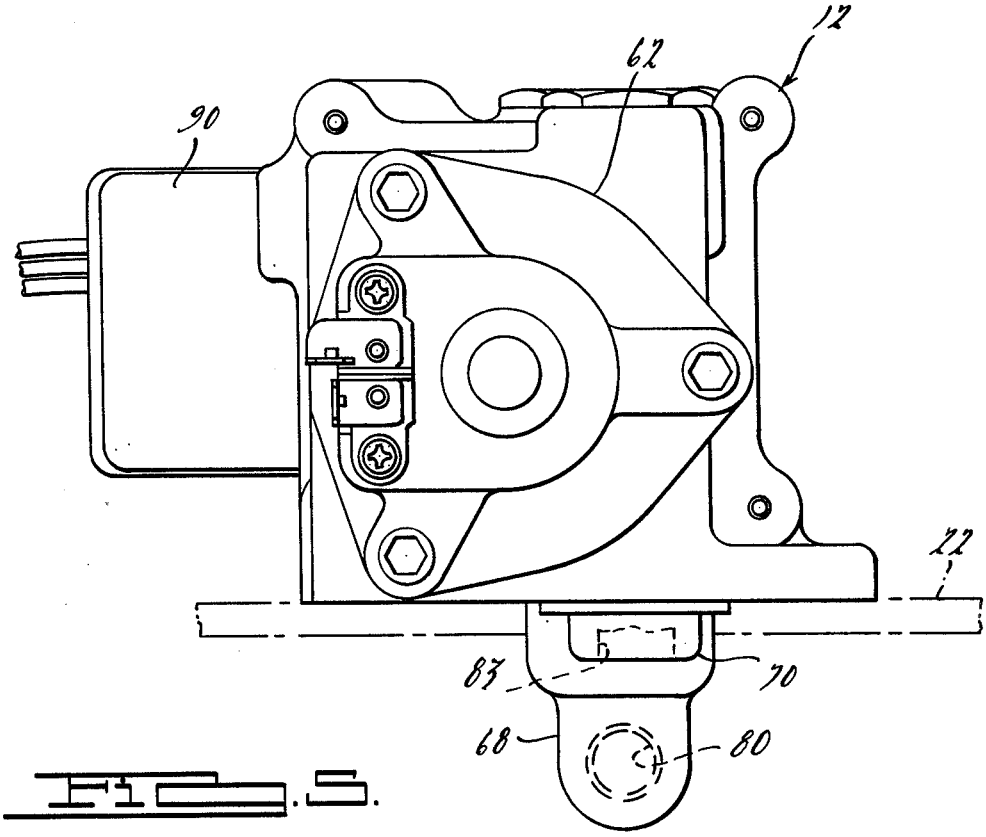
FIG. 5 is a view on a slightly enlarged scale taken in the direction arrows 5—5 in FIG. 2.

The drawings disclose an exemplary, but presently preferred, embodiment of mounting arrangement 10 for mounting a control pump 12 on a engine 14, only a portion of the engine being shown in the drawings. The example is for a typical V-8 automobile engine which comprises the usual intake manifold 16. A throttle body assembly 18 mounts on intake manifold 16 at the usual throttle body mounting flange provided on the top surface of the intake manifold. By way of illustration the throttle body assembly 18 is of the type disclosed in the pending application of Kenneth A. Graham and Kenneth W. Teague Ser. No. 719,021 filed Aug. 30, 1976, and assigned to the same assignee as the present application. Also by way of example control pump 12 is a motor driven gear pump including various component sections as will be explained more fully hereinafter.

In accordance with principles of the present invention, control pump 12 is contained within the induction air intake system 20, a portion of which is disposed on the engine by being mounted on throttle body assembly 18. Details of engine 14, manifold 16, and throttle body assembly 18 are unimportant insofar as the present invention is concerned and hence need not be described herein in the interest of clarity and brevity. Air intake structure 20 includes a sturdy, generally annular support element 22 which mounts on engine 14 by being attached to the body of throttle body assembly 18 by means of a plurality of fasteners 24. Control pump 12 mounts on element 22 by means of a plurality of fasteners 26. Element 22 includes a central aperture 28 which registers with a corresponding opening in throttle body assembly 18 to provide for passage of induction air from the air intake system into the engine. In the illustrated example, aperture 28 is rectangular in shape to register with a corresponding rectangular opening in throttle body assembly 18 which in turn registers with a rectangular intake opening in manifold 16 at the throttle body mounting flange thereof. Air flow into the engine is modulated by means of throttle blades 30 disposed in the opening in throttle body assembly 18. Element 22 has a circular outer periphery which terminates in an upstanding flange 32. Supported on flange 32 is an annular sheet metal housing element 34 providing a support surface for the usual annular air filter element 36. A sheet metal cover 38 encloses elements 22 and 34 and holds air filter element 36 in place. Cover 38 is secured by means of a wing nut 40 which is threaded onto a vertical stud 42 which is affixed to a bracket 44 fastened at its opposite ends to a boss 48 on element 22 and a boss 50 on control pump 12. A compressible, resilient sealing gasket 52 is provided to seal between elements 22 and 34 and another gasket 54 is provided between element 34 and cover 38. Thus, the elements 22, 34 and cover 38 cooperate to form an air filter housing for the engine within which control pump 12 is contained.

The exemplary preferred use of control pump 12 is in an electronic fuel metering system wherein the pump is controllably operated to meter the correct flow of fuel to the engine for the mass air flow into the engine under different engine operating conditions. Accordingly, sealing of the elements 22, 34 and cover 38 with respect to each other as well as the sealing of element 22 to the body of throttle body assembly 18 is desirable to prevent intrusion of air. Air flow into the engine is accomplished by means of an air inlet conduit (not shown) leading into the side wall of element 34. The conduit gathers generally cooler ambient air from a location remote from the engine. An air flow meter (which may be of the type shown in the pending application of Leonard P. Gau, Ser. No. 681,628 filing date Apr. 29, 1976 assigned to the same assignee as the present application) is located in this inlet conduit, (for example, an air flow meter and probe assembly which attaches to element 34) to exactly measure the volumetric air flow into the engine. Suitable electronics are provided to convert the volumetric measurement into a mass measurement and to operate control pump 12 to dispense the correct mass flow rate of liquid fuel into the engine so that at any instant of time a desired fuel/air ratio is introduced into the engine in accordance with how the engine is being operated.

In the illustrated embodiment, the fuel is dispensed through an outlet conduit 56 into a fuel spray bar and pressure regulator assembly 58 which sprays liquid fuel into throttle body assembly 18 for mixture with the inducted air to form the combustible mixture for the engine. Details of the pressure regulator and spray bar assembly 58 may be found in the aforementioned pending application Ser. No. 719,021. Thus, it will be appreciated that control pump 12 is contained entirely within the induction air intake system of the engine to be exposed to the cooling effect of the remotely scavenged air which passes through the air intake system into the engine. This is beneficial in minimizing the temperature levels to which the liquid fuel is exposed before it is sprayed into the induction passage of the throttle body assembly. Moreover, the pump is housed in otherwise vacant space and this promotes compact packaging and convenience. Element 22 tends to act as a heat shield for pump and motor assembly 12 by shielding the latter from engine heat. By way of example, element 22 may be fabricated from a glass-filled nylon or polyester to provide especially good insulating and strength properties.

In accordance with a further feature of the invention, pump 12 and element 22 are arranged and constructed to provide for connection of fuel lines to and from the fuel tank exteriorily of the air intake system. By way of example, pump 12 comprises a variable speed electric DC motor 62 to the shaft of which is connected a hydraulic pump shown generally at 64. The assembly also includes a flow meter and vapor separator stage shown generally at 66. The present invention is not concerned with details of the internal construction of motor 62, pump 64 and stage 66 and hence these will not be described in the interest of clarity and brevity. Suffice it to say that liquid fuel is supplied from an in-tank pump in a more than adequate amount to control pump 12 and motor 62 is controllably operated to operate pump 64 at speeds which produce the correct mass flow of fuel for spraying into the induction passage of the engine by the aforementioned arrangement. In accordance with this latter feature of the invention, pump 12 is provided with an inlet port 68 and a return port 70. Both ports 68 and 70 extend through corresponding openings 72 and 74 respectively in the bottom wall of support element 22. Suitable sealing gaskets 76 and 78 respectively are provided for sealing between the ports and their respective openings. Inlet port 68 is provided with a tapped hole 80 into which a fuel line fitting for a fuel supply line 82 can be threaded. Similarily, return port 70 is provided with a threaded hole 83 into which a fitting 84 of a fuel return line 86 may be threaded. In the illustrated embodiment inlet port 68 is provided in stage 66 so that entering fuel is caused to pass through a vapor separator 88 before entering the pump section of the assembly. The return port 70 is provided in pump section 64. As mentioned earlier, more than adequate fuel is delivered to inlet port 80 from an in-tank pump and excess fuel returns to the tank via return port 70. Liquid fuel also passes through internal passageways in the housing of pump section 64 to enter motor 62, the latter being a "wet" motor. A solid head of liquid fuel is provided at the inlet of the pumping element of pump 64, such pumping element being illustratively a gear type pump. The excess fuel with entrained fuel vapor returns to the tank via return port 70 and return line 86. The pumping element of pump 64 pumps liquid fuel at a controlled rate through a fluid flow meter contained within stage 66. The flow meter is of an electronic type and includes associated electronics packaged at 90. The fuel after passing through the flow meter is conducted through conduit 56 to the pressure regulator and spray bar assembly 58. It will thus be appreciated that the provision of the external fuel line connections to the control pump and motor assembly promotes ease of installation, and servicing should the latter be necessary.

There has thus been disclosed a novel mounting arrangement for a fuel metering control pump which accomplishes the foregoing advantages and benefits. While a preferred embodiment has been disclosed, it will be appreciated that other embodiments are contemplated within the scope of the present invention.

What is claimed is:

1. In combination:

an internal combustion engine having an intake manifold including an air-fuel mixture inlet;

an air intake system via which air is drawn into the engine via the inlet of said intake manifold, said air intake system comprising an annular support element disposed on the engine with a central aperture of the annular support element in communication with the inlet of said intake manifold, an annular air filter housing element having its inner periphery supported on the outer periphery of said annular support element, an annular air filter supported on said filter housing element, and a second air filter housing element cooperating with said filter and said two annular elements such that air conducted by the air intake system into the engine must flow through said filter;

a control pump disposed on said annular support element interiorily of said filter to be exposed to induction air passing through said air intake system;

means for supplying fuel to said control pump;

and, means for distributing fuel from the pump to the inlet of the intake manifold for mixture with air drawn into the engine via said air intake system.

2. The combination set forth in claim 1 wherein said control pump includes an inlet port and said annular support element includes an opening, said inlet port extending through said opening, and said means for supplying fuel to said control pump includes a fuel line connected to said inlet port at a location exterior of said air intake system.

3. The combination set forth in claim 1 wherein said annular support element comprises a generally horizontal base terminating at its outer periphery in an upstanding flange and said annular housing element seats on said flange.

4. The combination set forth in claim 3 including a sealing gasket sealing between said flange and said annular housing element.

5. The combination set forth in claim 1 including a throttle body assembly mounted on said intake manifold, said annular support element mounting on said throttle body assembly.

6. In combination:

an internal combustion engine having an intake manifold;

an air intake system for said engine including an annular support element mounted on the engine and having a central aperture thereof in communication with the air-fuel mixture inlet of the intake manifold;

a control pump supported on said annular support element within said air intake system to be exposed to induction air passing therethrough, said pump being operative to supply fuel for mixture with air drawn into the engine by said air intake system;

an opening in the wall of said support element;

said control pump including an inlet port which passes through said opening in said wall of said support element to provide for connection of a fuel supply line thereto exteriorly of said air intake system.

7. The combination set forth in claim 6 wherein said control pump includes a return port passing through a corresponding opening in the wall of said support element to provide for connection of a return line thereto exteriorly of said air intake system.

8. The combination set forth in claim 6 wherein said annular support element includes a generally planar horizontal wall terminating at its outer periphery in an upstanding flange and said opening is provided in said generally planar horizontal wall.

9. In combination:

an internal combustion engine having an induction air system;

an annular support element mounted on said engine defining a portion of said system with induction air passing through the area circumscribed by the inner periphery of said element;

a control pump supported on said element interiorly of the induction air system to be exposed to cooling by induction air and disposed adjacent the inner periphery of said element;

means for supplying fuel to said control pump; and means for distributing fuel pumped by the pump to the area circumscribed by the inner periphery of said element for mixture with the induction air passing therethrough.

* * * * *